US009266013B2

(12) United States Patent
Tseng

(10) Patent No.: US 9,266,013 B2
(45) Date of Patent: Feb. 23, 2016

(54) PLAYING CARD CONDUCTION STRUCTURE

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 24 days.

(21) Appl. No.: 14/242,829

(22) Filed: Apr. 1, 2014

(65) Prior Publication Data

US 2015/0273316 A1 Oct. 1, 2015

(51) Int. Cl.
*A63F 1/14* (2006.01)

(52) U.S. Cl.
CPC ..... *A63F 1/14* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 2,051,615 A * 8/1936 Miles ..... 273/149 P
3,529,829 A * 9/1970 Seifert ..... 273/149 P
4,969,648 A * 11/1990 Hollinger et al. ..... 273/149 R
5,575,475 A * 11/1996 Steinbach ..... 273/149 R
6,254,096 B1 * 7/2001 Grauzer et al. ..... 273/149 R
6,651,982 B2 * 11/2003 Grauzer et al. ..... 273/149 R
6,655,684 B2 * 12/2003 Grauzer et al. ..... 273/149 R
7,278,923 B2 * 10/2007 Grauzer et al. ..... 463/47
7,510,186 B2 * 3/2009 Fleckenstein ..... 273/149 R
7,967,672 B2 * 6/2011 Shigeta ..... 463/13
8,419,016 B2 * 4/2013 Yoseloff et al. ..... 273/149 R
8,523,684 B2 * 9/2013 Lutnick et al. ..... 463/47
8,678,389 B1 * 3/2014 Ho ..... 273/149 R
8,695,978 B1 * 4/2014 Ho ..... 273/149 R
8,702,328 B2 * 4/2014 Cronin et al. ..... 400/601

* cited by examiner

*Primary Examiner* — Michael Dennis
*Assistant Examiner* — Dolores Collins
(74) *Attorney, Agent, or Firm* — Raymond Y. Chan; David and Raymond Patent Firm

(57) ABSTRACT

A playing card conduction structure includes a base, a card case, a video camera, and an interruption sense device. The card case is disposed on the base and has positioning recesses to engage with positioning protrusions of the base. The base includes a conduction mechanism therein. The outer side of the base is provided with a power mechanism for supplying a power source to the conduction mechanism. The card case is provided with an inclined bottom board having a first opening and a second opening. A guide mechanism is in contact with playing cards through the first opening and the second opening. The power mechanism includes two separate powers with different rotation speeds. Thereby, the playing cards can be conducted stably to lower the mistake of conduction, such that the game process is smooth and quick to save time.

3 Claims, 9 Drawing Sheets

PLAYING CARD CONDUCTION STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a playing card conduction structure, and more particularly to a playing card conduction structure to deal playing cards stably for playing a card game smoothly and quickly to save time.

2. Description of Related Arts

For a Poker game, the playing cards need be shuffled and then dealt to the players. This action is handled manually, so the players may have a doubt of cheating. Therefore, a mechanical device is developed instead of shuffling and dealing manually. A conventional deal device, as shown in FIG. 1, comprises a base 2 and a box 3. The box has an inclined surface therein. The inclined surface can be separated. Joker playing cards 1 are stacked and placed in the box 3. A weight block 9 is provided behind the Joker playing cards 1. A link rod 4 is provided with a plastic wheel 5. The plastic wheel 5 is disposed at the opening of the box 3 to contact with the Joker playing cards 1. The base 2 is provided with a camera identification device 6 and a plurality of infrared sensors 7, 8 corresponding to the front of the opening of the box 3. By the aforesaid structure, the plastic wheel 5 is turned to bring out the Joker playing cards 1. The camera identification device 6 is to identify the pattern and numeric of the Joker playing cards 1. The infrared sensors 7, 8 are to monitor the accuracy of pass of the Joker playing cards 1. However, it has the following shortcomings. The Joker playing cards 1 are guided out by the plastic wheel 5. Sometimes, several Joker playing cards 1 are guided out at a time. It is necessary to obviate the mistake manually or to change the order of dealing, which causes that the outcome of the players is changed. The game process needs more time, and the players may question the fairness of the game to reduce the player's interest. Accordingly, the inventor of the present invention has devoted himself based on his many years of practical experiences to solve these problems for the playing cards to be conducted smoothly.

SUMMARY OF THE PRESENT INVENTION

The primary object of the present invention is to solve the aforesaid problems and to provide a playing card conduction structure. The playing card conduction structure is more practical.

The playing card conduction structure of the present invention comprises a card case with a bottom board. The bottom board has an inclination. A conduction mechanism comprises a first guide wheel, a second guide wheel, and a third wheel. The first, second, and third guide wheels correspond to the inclination of the bottom board. The second guide wheel is higher than the first guide wheel. The third guide wheel is higher than the second guide wheel. The first and second guide wheels extend out of the surface of the bottom board to contact with Joker playing cards so as to conduct the Joker playing cards. The Joker playing cards are against the rear board of the card case due to the inclination of the bottom board. The Joker playing cards can be conducted stably one by one through the guide wheels, such that the game process is smooth and quick to save time.

Another object of the present invention is to provide a power mechanism which comprises two separate powers with different rotation speeds. Thereby, the Joker playing cards can be conducted slowly in the beginning and pulled out to deal quickly so as to ensure that the Joker playing cards are sent one by one.

DETAILED DESCRIPTION OF THE PREFERRED EMBODIMENT

Figure 1:
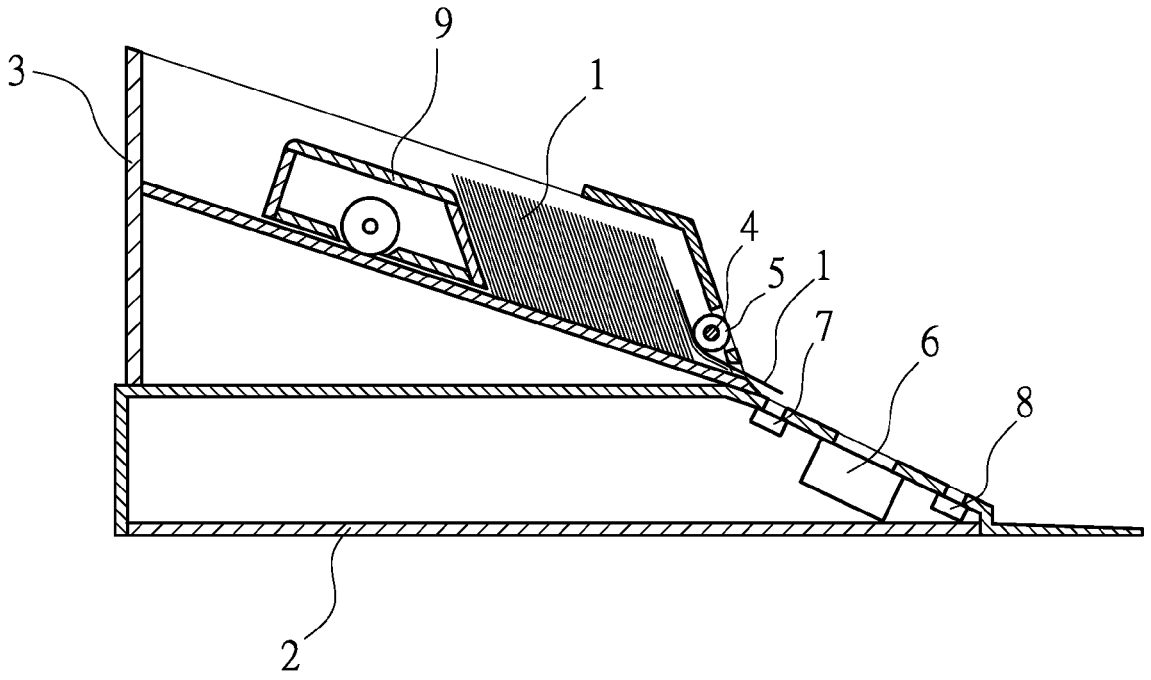
PRIOR ART FIG.1
FIG. 1 is a sectional view of a conventional deal device.
Figure 2:
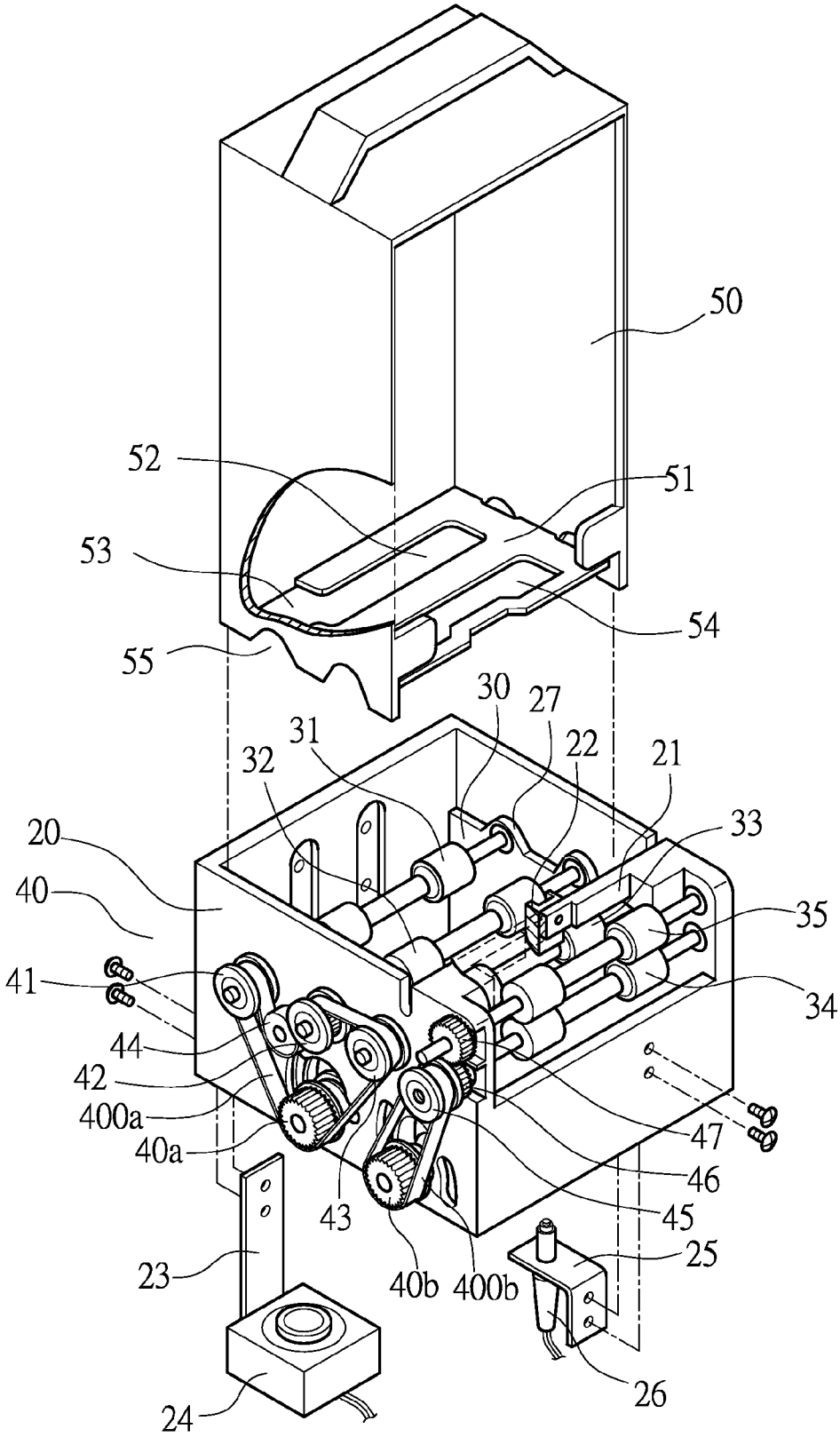
FIG. 2 is an exploded view according to a preferred embodiment of the present invention.
Figure 3:
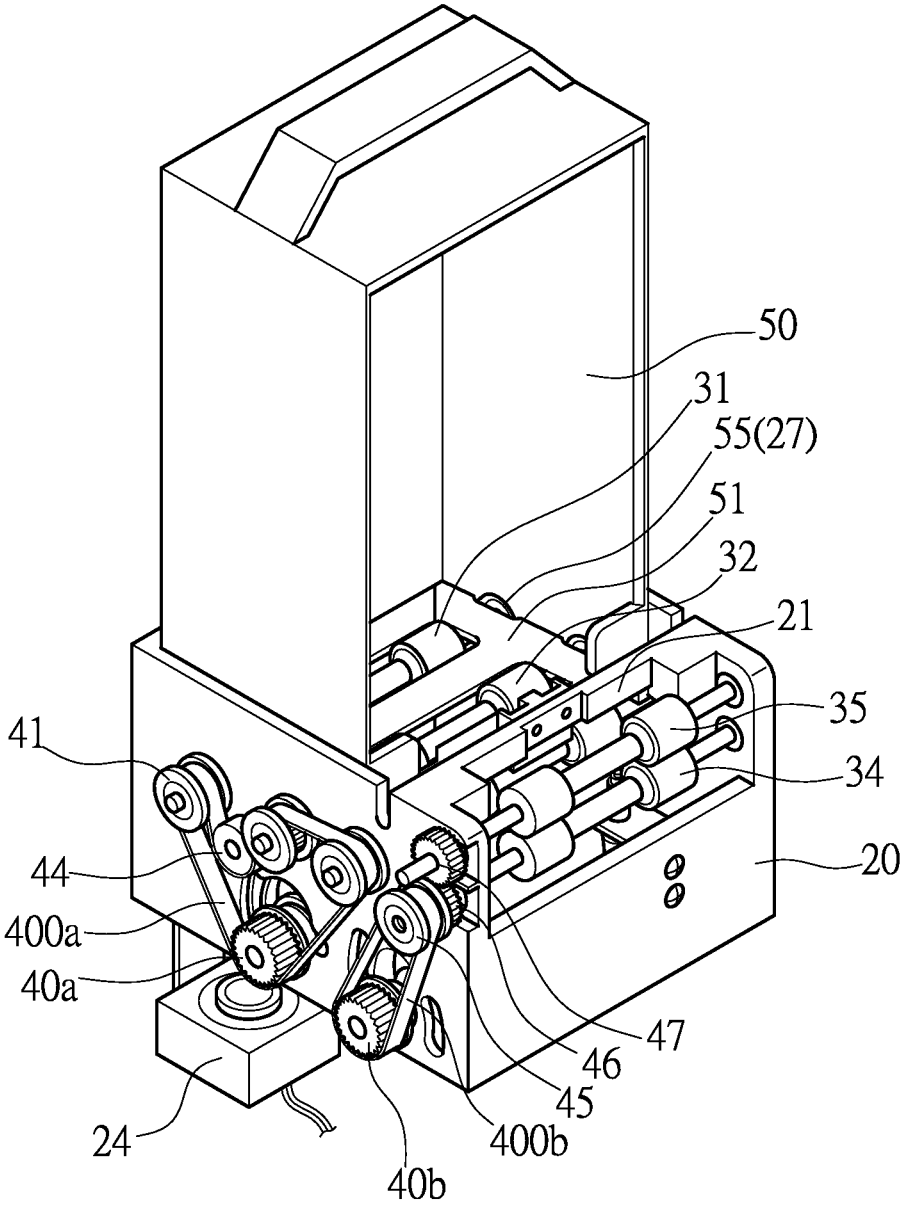
FIG. 3 is a perspective view according to the preferred embodiment of the present invention.

Embodiments of the present invention will now be described, by way of example only, with reference to the accompanying drawings.

As shown in FIG. 1 to FIG. 4, the playing card conduction structure of the present invention comprises a base 20, a card case 50, a video camera 24, and an interruption sense device 26.

The base 20 comprises a conduction mechanism 30 therein. An outer side of the base 20 is provided with a power mechanism 40 for supplying a power source to the conduction mechanism 30. The base 20 has a crossbeam 21 above the conduction mechanism 30 and a guide block 22 at the center of the crossbeam 21. The guide block 22 has a curved surface. Two inner sides of the base 20 are provided with positioning protrusions 27.

The conduction mechanism 30 comprises a first guide wheel 31, a second guide wheel 32, a third guide wheel 33, and a fourth guide wheel 34 arranged in sequence. An upper press wheel 35 is provided above the fourth guide wheel 34 and is in contact with the fourth guide wheel 34. The upper press wheel 35 is turned in a reverse direction relative to the fourth wheel 34. The second guide wheel 32 is higher than the first guide wheel 31. The third guide wheel 33 is higher than the second guide wheel 32. The guide block 22 is disposed above the third guide wheel 33. The fourth guide wheel 34 and the third guide wheel 33 are disposed at an identical altitude for horizontal conduction.

The power mechanism 40 comprises a first drive motor 10 coupled with a speed changing box 12 to reduce rotation speed. The front end of the speed changing box 12 is coupled with a first drive gear 40*a*. A first drive belt 400*a* is provided to drive a first pulley 41, a second pulley 42 and a third pulley 43. The first guide wheel 31 and the first pulley 41 are disposed coaxially. The second guide wheel 32 and the second pulley 42 are disposed coaxially. The third guide wheel 33 and the third pulley 43 are disposed coaxially. The first guide wheel 31, the second guide wheel 32, and the third guide wheel 33 are respectively driven by the first pulley 41, the second pulley 42, and the third pulley 43 to turn. A transmission wheel 44 is provided between the first pulley 41 and the second pulley 42 to increase the contact area between the first drive belt 400*a* and the first pulley 41 as well as the second pulley 42, so that the first pulley 41, the second pulley 42, and the third pulley 43 are turned more stably. The power mechanism 40 further comprises a second drive motor 11 coupled with a second drive gear 40*b*. A second drive belt 400*b* is provided to drive a fourth pulley 45. The fourth guide wheel 34 and the fourth pulley 45 are disposed coaxially. The fourth guide wheel 34 is driven by the fourth pulley 45 to turn. The fourth pulley 45 is provided with a transmission gear 46. The fourth pulley 45 and the transmission gear 46 are disposed coaxially. An outer side of the upper press wheel 35 is provided with a driven gear 47 to mesh with the transmission gear 46, so that the upper press wheel 35 is turned reversely. The upper press wheel 35 and the driven gear 47 are disposed coaxially.

The card case 50 is disposed on the base 20. Two sides of the bottom of the card case 50 have positioning recesses 55 to engage with the positioning protrusions 27 inside the base 20, such that the card case 50 can be secured above the conduction mechanism 30 stably, without displacement. The bottom of the card case 50 is provided with an inclined bottom board 51. The inclination of the bottom board 51 corresponds to the first, second and third guide wheels 31, 32, 33. The bottom board 51 has a first opening 52 and a second opening 54. One corner of the bottom board 51 has an identification hole 53. The identification hole 53 corresponds in position to the numeric and the pattern of Poker playing cards 1. The first guide wheel 31 and the second guide wheel 32 are in contact with the playing cards through the first opening 52 and the second opening 54 so as to conduct the playing card.

The video camera 24 is locked to the inner wall of the base 20 through an extension plate 23 and disposed under the conduction mechanism 30 to record the numeric and the pattern of the Poker playing cards through the identification hole 53.

The interruption sense device 26 is locked to the inner wall of the base 20 through a fixing plate 25 and disposed between the third guide wheel 33 and the fourth guide wheel 34 to sense pass of the Joker playing cards 1 and to count the Joker playing cards 1.

By the aforesaid structure, the playing cards can be conducted out stably one by one, so the game process can be smooth and quick to save time.

The details of the present invention are described hereinafter. As shown in FIG. 1 to FIG. 4, the present invention is placed in a game system and controlled by the command of the system. The card case 50 is first disengaged from the base 20 for placing Joker playing cards 1 therein, and then coupled to the base 20 to proceed with dealing. The inclination of the bottom board 51 makes the Joker playing cards 1 slide toward the rear board of the card case 50 subject to gravity, so that the stack of Joker playing cards 1 won't topple over easily. The curved surface of the guide block 22 guides the Joker playing cards 1 which are sent obliquely through the first, second and third guide wheels 31, 32, 33 to the position between the fourth guide wheel 34 and the upper press wheel 35 in a horizontal direction for the Joker playing cards 1 to be pulled out stably and quickly.

Figure 4:
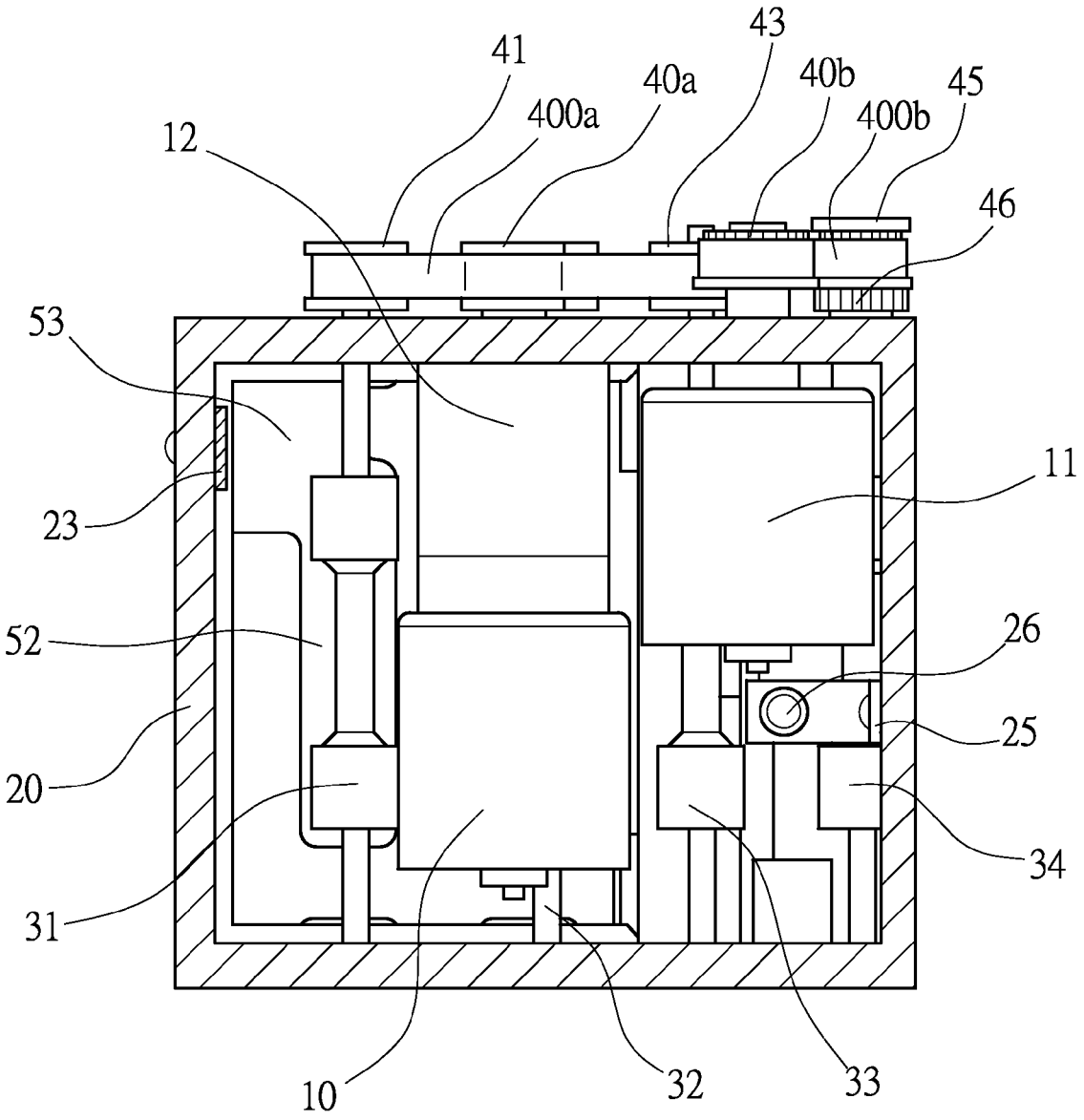
FIG. 4 is a bottom sectional view according to the preferred embodiment of the present invention.
Figure 5:
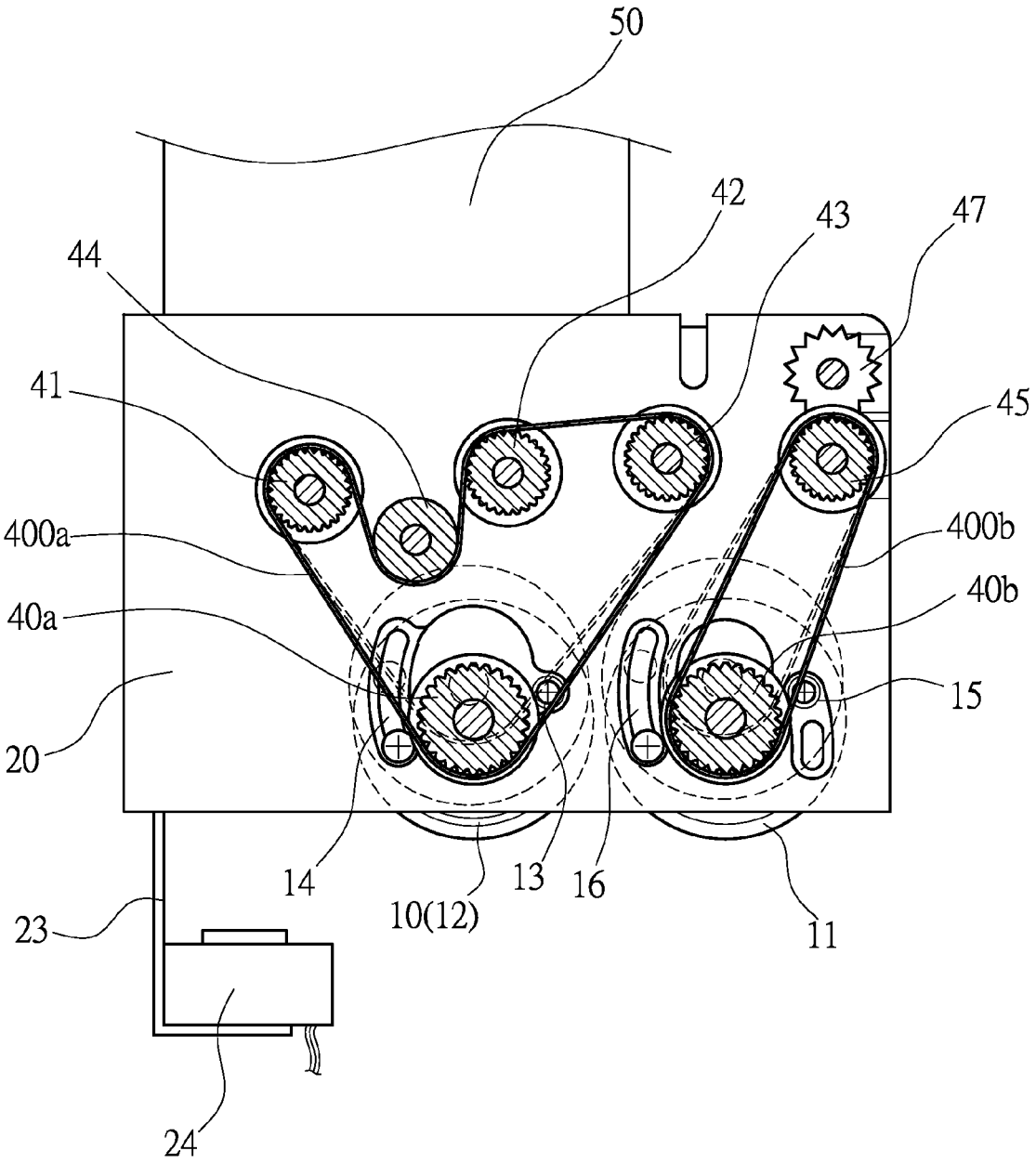
FIG. 5 is a side sectional view showing the power mechanism according to the preferred embodiment of the present invention.

Referring to FIG. 4 and FIG. 5, the side of the base 20 has a first lock hole 13 and a first curved groove 13. One side of the speed changing box 12 is pivotally connected to the first lock hole 13 and another side of the speed changing box 12 is locked to the first curved groove 14, such that the speed changing box 13 can be pivoted about the first lock hole 13 to adjust the tightness of the first drive belt 400*a*. The side of the base 20 further has a second lock hole 15 and a second curved groove 16. One side of the second drive motor 11 is pivotally connected to the second lock hole 15 and another side of the second drive motor 11 is locked to the second curved groove 16, such that the second drive motor 11 can be pivoted about the second lock hole 15 to adjust the tightness of the second drive belt 400*b*.

Figure 6:
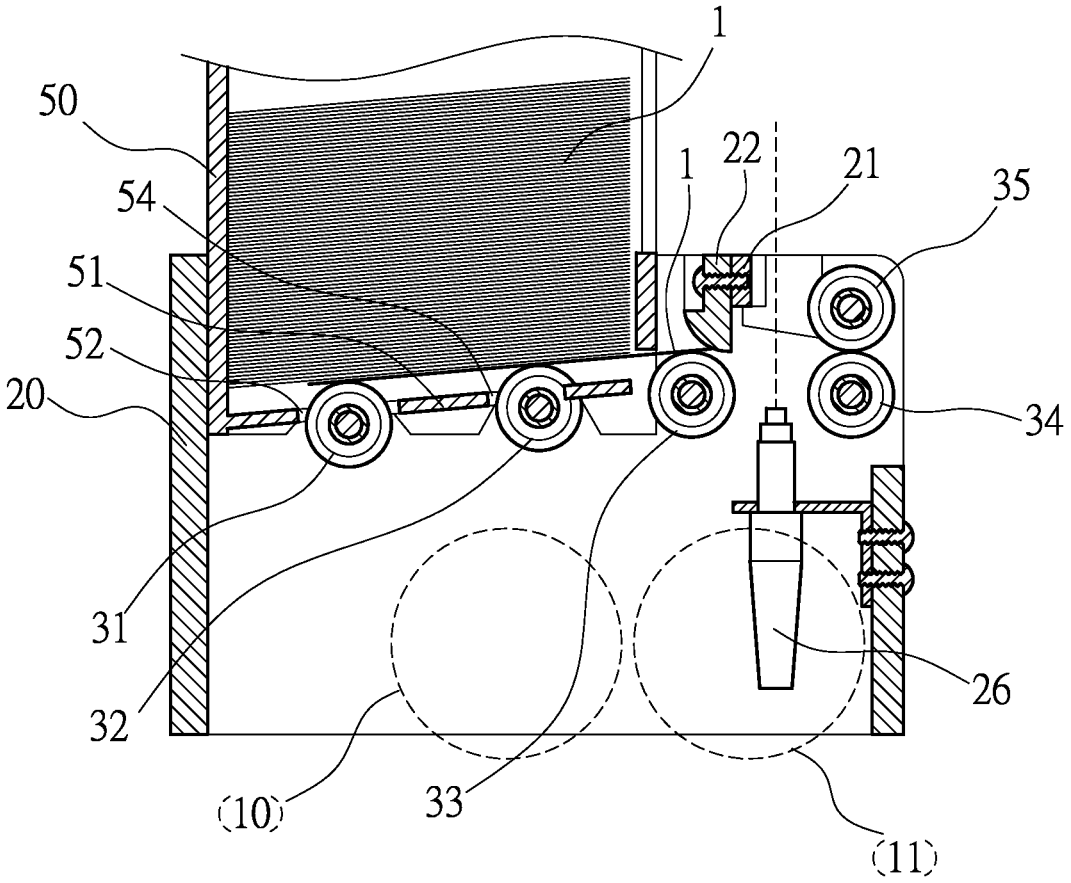
FIG. 6 is a side sectional view showing the first Joker playing card leaning against the guide block according to the preferred embodiment of the present invention.
Figure 7:
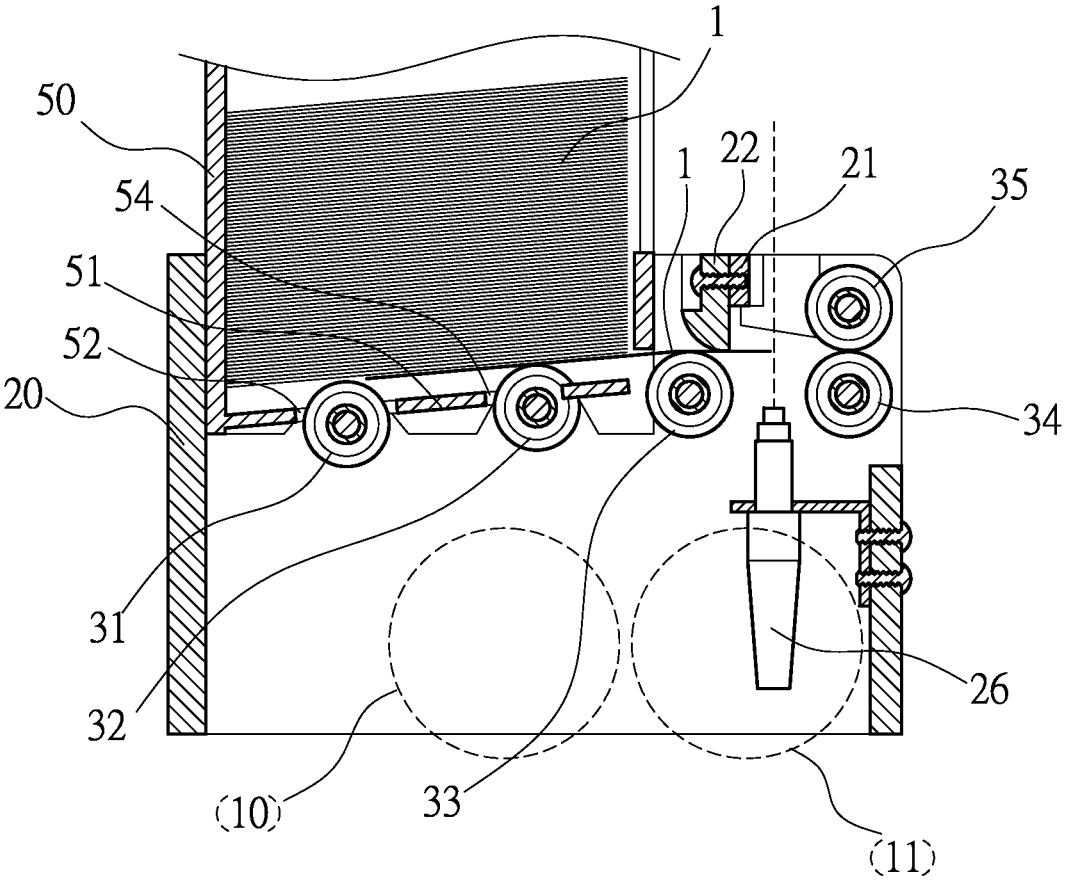
FIG. 7 is a side sectional view showing the first Joker playing card passing through the guide block according to the preferred embodiment of the present invention.
Figure 8:
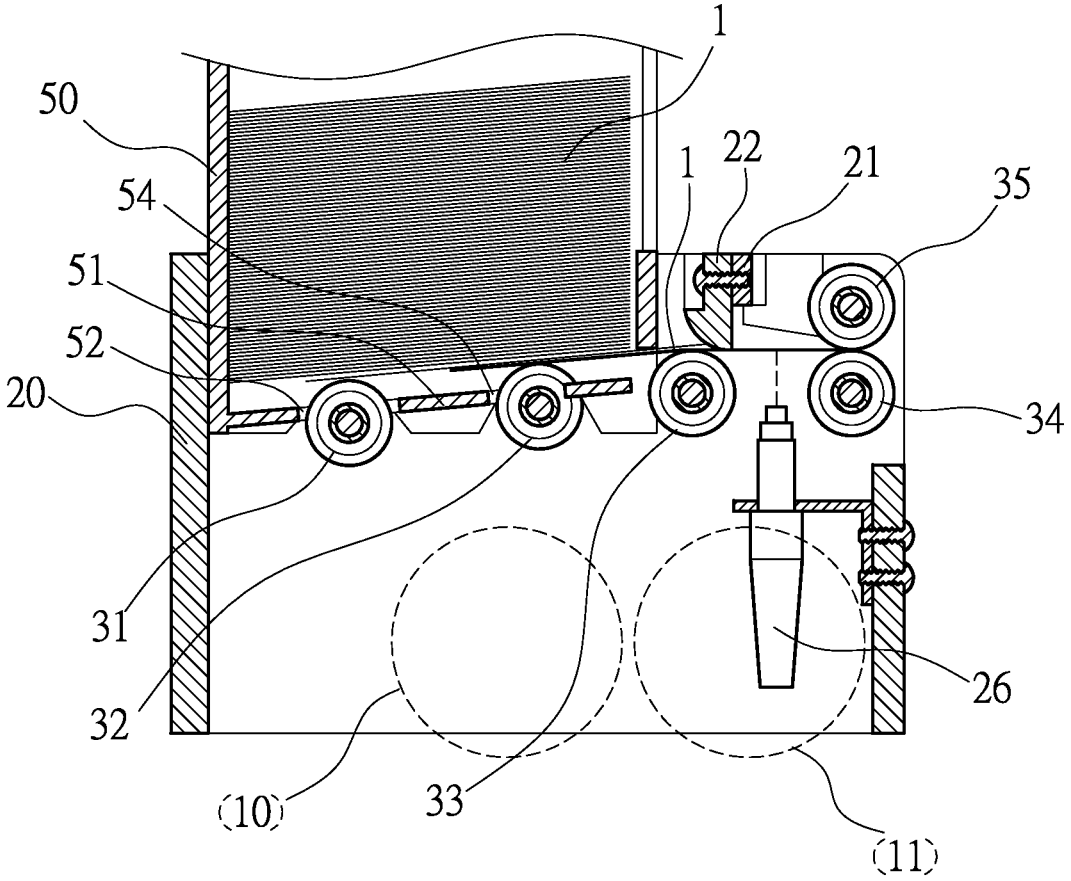
FIG. 8 is a side sectional view showing the second Joker playing card being pushed according to the preferred embodiment of the present invention.
Figure 9:
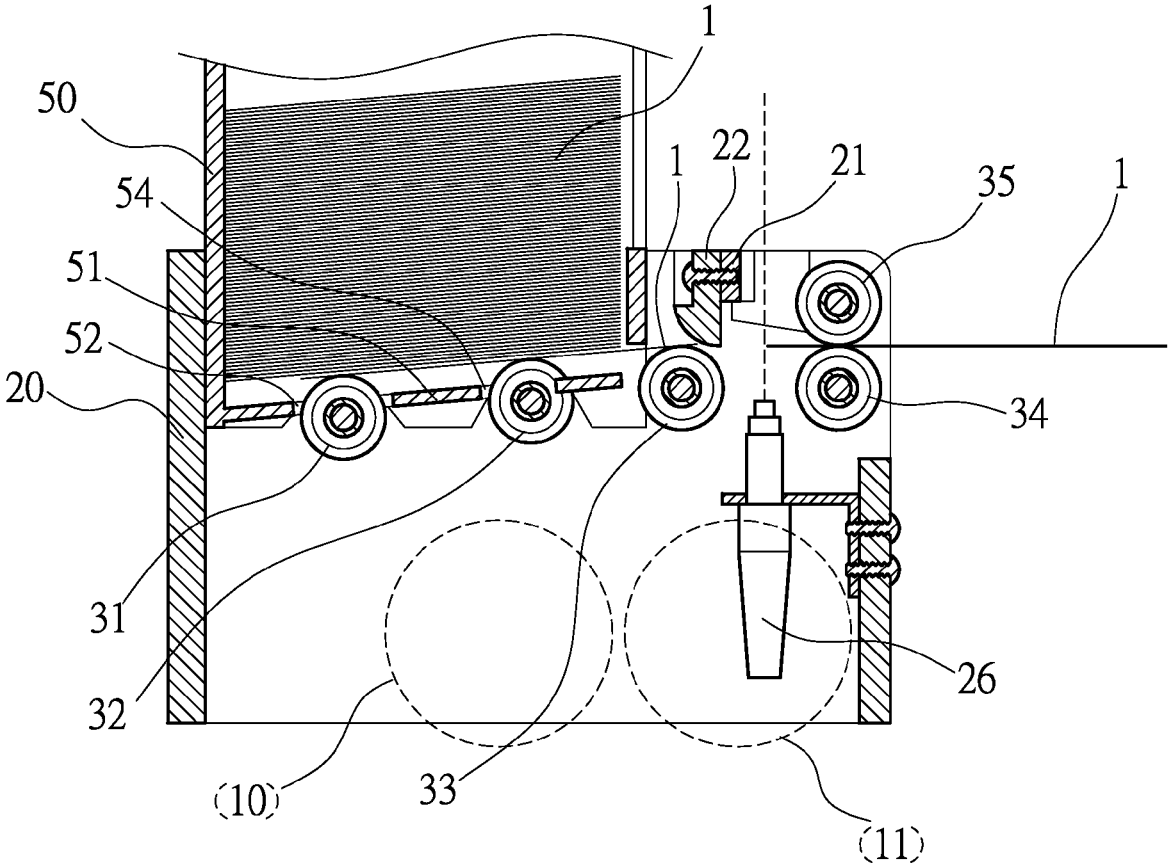
FIG. 9 is a side sectional view showing the Joker playing card passing through the fourth guide wheel according to the preferred embodiment of the present invention.

Referring to FIG. 6 to FIG. 9, when the game system is about to deal, the Joker playing cards 1 which have been shuffled are placed into the card case 50, and then the card case 50 is coupled to the base 20. The first and second guide wheels 31, 32 respectively pass through the first and second openings 52, 54 to contact with the Joker playing cards 1. This moment, the video camera 24 is to identify and record the pattern and numeric of the first Joker playing card 1 through the identification hole 53, and the first and second drive motors 10, 11 are started simultaneously. The first drive motor 10 drives the first, second and third guide wheels 31, 32, 33 to turn slowly through the speed changing box 12. The second drive motor 11 drives the fourth guide wheels 34 to turn quickly. The Joker playing card 1 is pushed forward by the first and second guide wheels 31, 32 to pass through the third guide wheel 33 and to lean against the guide block 22, as shown in FIG. 6. At this time, the video camera 24 is to identify and record the pattern and numeric of the second Joker playing card 1 through the identification hole 53, and then the Joker playing card 1 is pushed forward by the turning friction of the first, second and third guide wheels 31, 32, 33, such that the Joker playing card 1 is moved forward in the horizontal direction along with the curved surface of the guide block 22, as shown in FIG. 7, to pass above the interruption sense device 26. This enables the game system to sense pass of the Joker playing card 1. The first Joker playing card 1 continues to move forward to be gradually away from the first guide wheel 31, and the first guide wheel 32 is in contact with the second Joker playing card 1 to be moved forward until the second Joker playing card 1 is stopped by the guide block 22, as shown in FIG. 8. Because the second Joker playing card 2 is only subject to the turning friction of the first guide wheel 31, its advance force is less. Further, the first Joker playing card 1 is pushed to a slightly high position to lean against the guide block 22. The second Joker playing card 1 doesn't have enough propulsive force to bend and pass between the guide block 22 and the third guide wheel 33, so it is stopped and cannot move forward. At this time, the video camera 24 is to identify and record the pattern and numeric of the third Joker playing card 1 through the identification hole 53. When the first Joker playing card 1 enters between the fourth guide wheel 34 and the upper press wheel 35, it will be pulled out quickly. And, the interruption sense device 26 is not interrupted to complete the count and to notify the first drive motor 10 of stopping turning. After the first Joker playing card 1 is fully away from the fourth guide wheel 34 and the upper press wheel 35, the game system completes the deal of the first Joker playing card 1. Through the aforesaid structure, the playing cards can be conducted out stably one by one, so the game process is smooth and quick to save time.

Through the foregoing structure, the present invention provides a device to print, output, and recycle the playing cards of the electronic automation playing card game system for the players to get and squint at the playing cards like a real poker. The present invention enhances the fun and excitement of the game.

What is claimed is:

1. A playing card conduction structure, comprising a base, a card case, a video camera, and an interruption sense device;

the base comprising a conduction mechanism therein, an outer side of the base being provided with a power mechanism for supplying a power source to the conduction mechanism, the base having a crossbeam above the conduction mechanism and a guide block at a central portion of the crossbeam, the guide block having a curved surface, two inner sides of the base being provided with positioning protrusions;

the conduction mechanism comprising a first guide wheel, a second guide wheel, a third guide wheel, and a fourth guide wheel arranged in sequence, an upper press wheel being provided above the fourth guide wheel to contact with the fourth guide wheel, the second guide wheel being higher than the first guide wheel, the third guide wheel being higher than the second guide wheel, the guide block being disposed above the third guide wheel, the fourth guide wheel and the third guide wheel being disposed at an identical altitude;

the card case being disposed on the base, two sides of a bottom of the card case having positioning recesses to engage with the positioning protrusions inside the base, the bottom of the card case being provided with an inclined bottom board, the bottom board having an inclination to match with the first, second and third guide wheels, the bottom board having a first opening and a second opening, one corner of the bottom board having an identification hole, the identification hole corresponding in position to the numeric and pattern of playing cards, the first guide wheel and the second guide wheel being in contact with the playing cards through the first opening and the second opening to conduct the playing cards;

the video camera being locked to an inner wall of the base through an extension plate and disposed under the conduction mechanism to record the numeric and the pattern of the playing cards through the identification hole;

the interruption sense device being locked to the inner wall of the base through a fixing plate and disposed between the third guide wheel and the fourth guide wheel to sense pass of the playing cards and to count the playing cards;

wherein the power mechanism comprises a first drive motor coupled with a speed changing box to decelerate, a front end of the speed changing box being coupled with a first drive gear, a first belt being provided to drive a first pulley, a second pulley and a third pulley, the first guide wheel and the first pulley being disposed coaxially, the second guide wheel and the second pulley being disposed coaxially, the third guide wheel and the third pulley being disposed coaxially, the first guide wheel, the second guide wheel, and the third guide wheel being respectively driven by the first pulley, the second pulley and the third pulley to turn, the power mechanism further comprising a second drive motor coupled with a second drive gear, a second drive belt being provided to drive a fourth pulley, the fourth guide wheel and the fourth pulley being disposed coaxially, the fourth guide wheel being driven by the fourth pulley to turn, the fourth pulley being provided with a transmission gear, the fourth pulley and the transmission gear being disposed coaxially, an outer side of the upper press wheel being provided with a driven gear to mesh with the transmission gear, the upper press wheel and the driven gear being disposed coaxially.

2. The playing card conduction structure as claimed in claim 1, wherein a transmission wheel is provided between the first pulley and the second pulley and driven by the first drive belt.

3. The playing card conduction structure as claimed in claim 1, wherein the outer side of the base has a first lock hole and a first curved groove, one side of the speed changing box being pivotally connected to the first lock hole, another side of the speed changing box being locked to the first curved groove, the speed changing box being able to pivot so as to adjust tightness of the first drive belt, the outer side of the base further having a second lock hole and a second curved groove, one side of the second drive motor being pivotally connected to the second lock hole, another side of the second drive motor being locked to the second curved groove, the second drive motor being able to pivot to adjust tightness of the second drive belt.

* * * * *